US010267301B2

(12) United States Patent
Kim et al.

(10) Patent No.: US 10,267,301 B2
(45) Date of Patent: Apr. 23, 2019

(54) RECIPROCATING COMPRESSOR

(71) Applicant: LG ELECTRONICS INC., Seoul (KR)

(72) Inventors: Dowan Kim, Seoul (KR); Sanghyun Lim, Seoul (KR); Inho Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 525 days.

(21) Appl. No.: 14/936,487

(22) Filed: Nov. 9, 2015

(65) Prior Publication Data

US 2016/0131123 A1 May 12, 2016

(30) Foreign Application Priority Data

Nov. 10, 2014 (KR) ..... 10-2014-0155388

(51) Int. Cl.

| | |
|---|---|
| ***F04B 39/00*** | (2006.01) |
| ***F04B 35/01*** | (2006.01) |
| ***F04B 39/12*** | (2006.01) |
| *F04B 39/14* | (2006.01) |

(52) U.S. Cl.

CPC ..... *F04B 39/0061* (2013.01); *F04B 39/0027* (2013.01); *F04B 39/0072* (2013.01); *F04B 39/123* (2013.01); *F04B 39/14* (2013.01)

(58) Field of Classification Search

CPC ..... F04B 39/0027; F04B 39/0061; F04B 39/0072; F04B 39/0066; F04B 39/123; F04B 39/125; F04B 39/14; Y10S 181/403

See application file for complete search history.

(56) References Cited

U.S. PATENT DOCUMENTS

| | | | | |
|---|---|---|---|---|
| 4,401,418 | A | 8/1983 | Fritchman | |
| 6,520,289 | B1 * | 2/2003 | Bo | F04B 39/0027 181/229 |
| 6,533,064 | B1 * | 3/2003 | Kim | F04B 39/0066 181/250 |

(Continued)

FOREIGN PATENT DOCUMENTS

| | | | |
|---|---|---|---|
| CN | 1338030 | A | 2/2002 |
| CN | 101033739 | A | 9/2007 |

(Continued)

*Primary Examiner* — Dominick L Plakkoottam

(74) *Attorney, Agent, or Firm* — Birch, Stewart, Kolasch & Birch, LLP

(57) ABSTRACT

A reciprocating compressor including a shell, a suction pipe, a driver located at the inner portion of the shell to generate a rotary force, a compressor located in the shell and a muffler assembly is provided. The compressor includes a connecting rod configured to convert the rotary force to a linear driving force, a piston connected to the connecting rod and a cylinder into which the piston is movably inserted is provided. The muffler assembly is configured to transfer a refrigerant suctioned through the suction pipe to the cylinder and includes a suction muffler having an inner portion and a suction hole through which a refrigerant is suctioned, an inner pipe installed at the inner portion of the suction muffler, the inner pipe having a bent portion, the inner pipe providing communication between the suction hole and the cylinder and a coupler disposed at the bent portion.

11 Claims, 9 Drawing Sheets

(56) References Cited

U.S. PATENT DOCUMENTS

2014/0322040 A1* 10/2014 Cho ..... F04B 39/0072
417/312

FOREIGN PATENT DOCUMENTS

| | | | | |
|---|---|---|---|---|
| CN | 101545472 | A | | 9/2009 |
| CN | 203879709 | U | * | 10/2014 |
| CN | 203879709 | U | | 10/2014 |
| IT | 1218949 | | * | 1/1988 |
| KR | 10-2007-0105573 | A | | 10/2007 |
| KR | 10-2014-0127081 | A | | 11/2014 |

* cited by examiner

RECIPROCATING COMPRESSOR

CROSS-REFERENCE TO RELATED APPLICATION

This application claims priority under 35 U.S.C. § 119 to Korean Application No. 10-2014-0155388, filed in Korea on Nov. 10, 2014, the entire contents of which is hereby incorporated by reference.

BACKGROUND OF THE INVENTION

1. Field of the Invention

The present disclosure relates, generally, to a reciprocating compressor and, more particularly, to a reciprocating compressor including a muffler assembly.

2. Description of the Related Art

A reciprocating compressor refers to an apparatus that compresses a fluid by discharging a refrigerant after suctioning and compressing the refrigerant by a reciprocating motion of a piston inside a cylinder. The reciprocating compressor can be classified as a connected type reciprocating compressor or a vibrating type reciprocating compressor in accordance with a method for driving the piston. A connected type reciprocating compressor compresses a refrigerant by a reciprocating motion inside a cylinder of a piston connected to a rotary shaft of a driving unit through a connecting rod and a vibrating type reciprocating compressor compresses a refrigerant by a reciprocating motion inside a cylinder of a piston which vibrates by being connected to a mover of a reciprocating motor.

A connected type reciprocating compressor is disclosed in Korean Unexamined Patent Application Publication No. 10-2010-0085760. The connected type reciprocating compressor disclosed in this unexamined patent application includes a housing shell forming a closed space, a driving unit disposed inside the housing shell to provide a driving force, a compression unit connected to a rotary shaft of a driving unit to compress a refrigerant by a reciprocating motion of a piston inside a cylinder using the driving force of the driving unit, and a suction/discharge unit suctioning a refrigerant and discharging the refrigerant compressed by the reciprocating motion of the compression unit.

A suction muffler for attenuating a flow noise, a pressure pulse, or the like generated when a refrigerant is suctioned may be installed at the suctioning side of the suction/discharge unit. Korean Published Application No. 10-2014-0060144, titled "Suction Muffler of Compressor", published May 19, 2014, filed by the present applicant is directed to such a suction muffler.

A compressor in accordance with Korean Published Application No. 10-2014-0060144, may not provide a great effect in improving vibration or noise caused by a refrigerant flowing in an inner portion of a suction muffler, and there may be a problem in that inner elements of the suction muffler may be damaged due to vibration.

SUMMARY OF THE INVENTION

To solve the problem mentioned above, the present disclosure is directed to providing a reciprocating compressor having a suction muffler capable of attenuating vibration or noise generated in a process of suctioning a refrigerant.

According to an embodiment of the present disclosure, a reciprocating compressor includes: a shell to which a suction pipe is coupled; a driving unit mounted inside the shell to generate a rotary force; a compression unit having a connecting rod configured to convert the rotary force to a linear driving force, a piston connected to the connecting rod, and a cylinder into which the piston is movably inserted; and a muffler assembly configured to transfer a refrigerant suctioned through the suction pipe to the cylinder, wherein the muffler assembly includes: a suction muffler having a suction hole through which a refrigerant is suctioned; an inner pipe installed inside the suction muffler, and having a bent portion; and a coupling unit disposed at the bent portion, and coupled to the suction muffler.

In addition, the inner pipe may include a first pipe main body configured to extend from the suction hole in one direction; and a second pipe main body configured to extend from the first pipe main body in another direction, wherein the bent portion is formed at a portion at which the first pipe main body is connected to the second pipe main body.

In addition, the one direction may be a horizontal direction, and the other direction may be a vertical direction.

In addition, the inner pipe may further include a first coupling unit disposed at the first pipe main body and coupled to an inner portion of the suction hole; and a second coupling unit disposed at the second pipe main body and coupled to one surface of the suction muffler, and the coupling unit mentioned above may be a third coupling unit.

In addition, the suction muffler may include a first assembly, and a second assembly coupled to an upper portion of the first assembly.

In addition, the first assembly may include a first fixing unit coupled to the first coupling unit, and the first fixing unit may include a fitting groove into which the first coupling unit is inserted.

In addition, the first fixing unit may further include a filter installed at the fitting groove to filter a foreign substance in a refrigerant introduced through the suction hole.

In addition, the suction muffler may further include a second fixing unit disposed at an upper surface of the second assembly and having a groove to which the second coupling unit is coupled.

In addition, the suction muffler may further include a third fixing unit disposed at a bottom surface of the first assembly, and to which the third coupling unit is coupled.

In addition, the third fixing unit may include a plurality of protrusions; and seating grooves formed between the plurality of protrusions and into which the third coupling unit is inserted.

In addition, the suction muffler may further include a support unit disposed apart from the third fixing unit at the bottom surface of the first assembly to support a lower portion of the inner pipe.

According to another aspect of the present disclosure, a reciprocating compressor includes: a shell to which a suction pipe is coupled; a driving unit mounted inside the shell to generate a rotary force; a compression unit having a connecting rod configured to convert the rotary force to a straight driving force, a piston connected to the connecting rod, and a cylinder into which the piston is movably inserted; a suction muffler configured to transfer a refrigerant suctioned through the suction pipe to the cylinder; an inner pipe installed inside the suction muffler, and having a first pipe main body configured to extend in one direction, a second pipe main body configured to extend in another direction, and a connection unit configured to connect the first pipe main body to the second pipe main body; a first coupling unit disposed at the first pipe main body to be coupled to the suction muffler; a second coupling unit disposed at the second pipe main body to be coupled to the suction muffler; and a third coupling unit disposed at the connection unit to be coupled to the suction muffler.

In addition, the suction muffler may include a first assembly and a second assembly coupled to an upper portion of the first assembly, and the first coupling unit and the second coupling unit may be coupled to the first assembly and the second assembly, respectively.

In addition, the first pipe main body may extend from a suction hole of the suction muffler in a horizontal direction, and the second pipe main body may extend upward from the first pipe main body.

In addition, a third fixing unit having a groove to which the third coupling unit is coupled may be further included at a lower surface of the first assembly.

BRIEF DESCRIPTION OF THE DRAWINGS

Embodiments will be described in detail with reference to the following drawings in which like reference numerals refer to like elements, and wherein.

DETAILED DESCRIPTION OF THE PREFERRED EMBODIMENTS

The present disclosure will become more apparent by describing preferred embodiments of the present disclosure in detail with reference to the accompanying drawings. The embodiments described herein are illustratively shown to help in understanding of the present disclosure, and it should be understood that the present disclosure may be executed in various ways that differ from the embodiments described herein. In addition, to assist in understanding of the present disclosure, the accompanying drawings may not reflect actual scale, and the size of some elements may be exaggerated.

Figure 1:
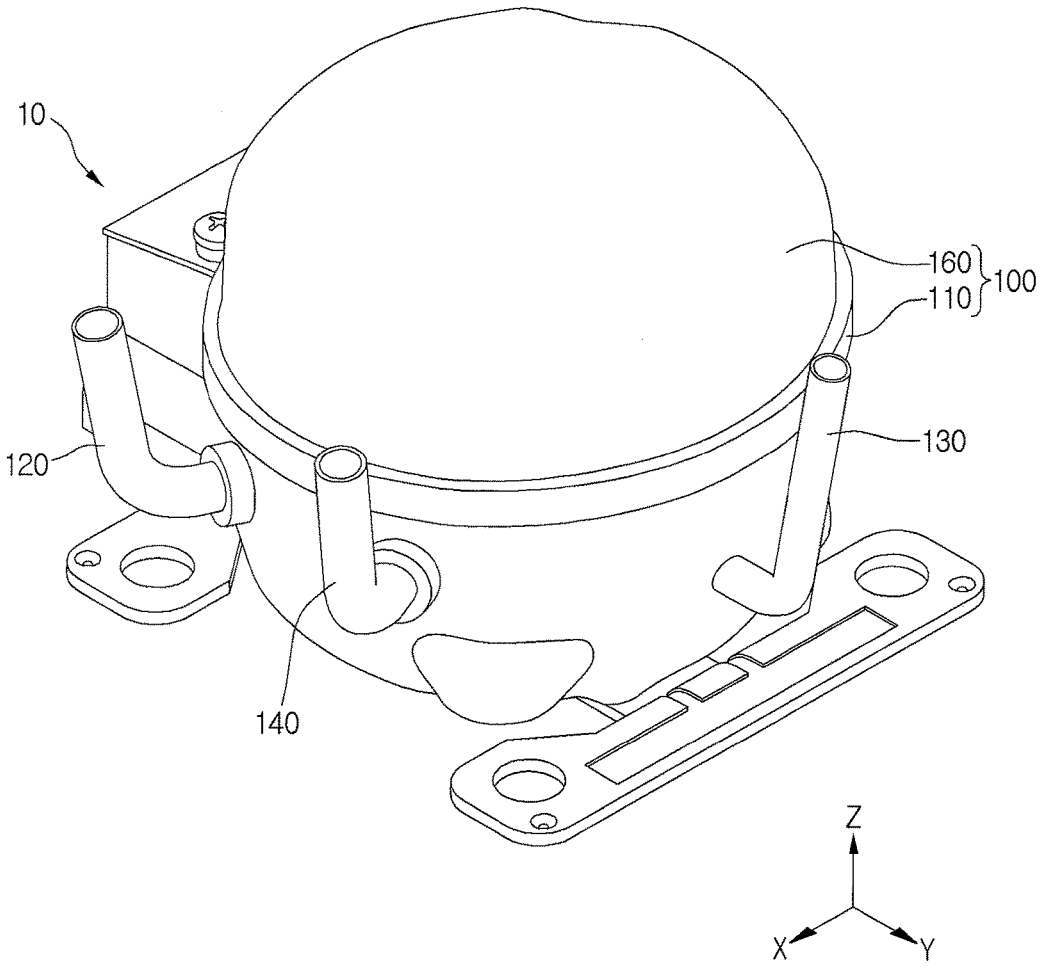
FIG. 1 is a perspective view of a reciprocating compressor according to an embodiment of the present disclosure.
Figure 2:
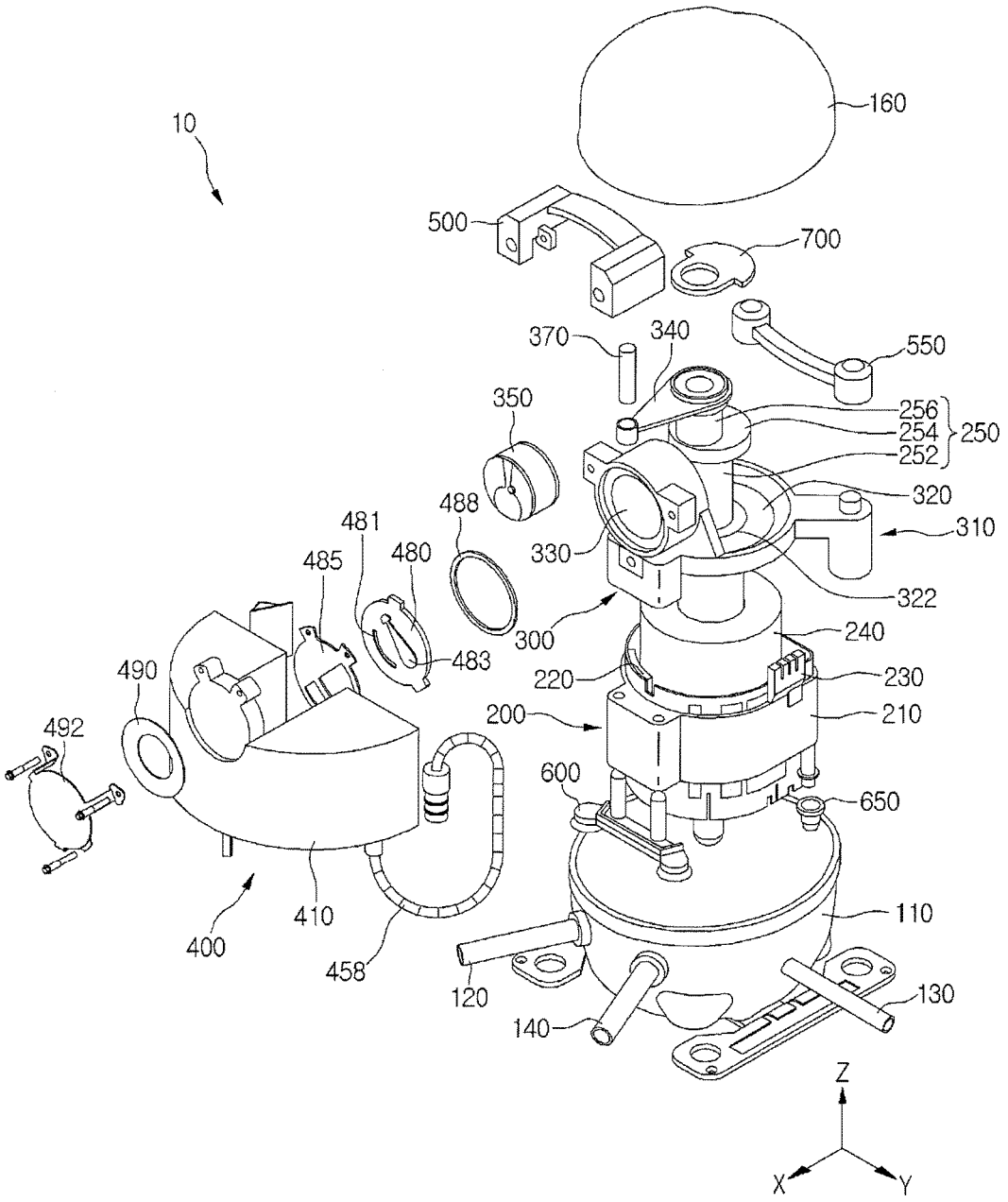
FIG. 2 is an exploded perspective view of a reciprocating compressor according to an embodiment of the present disclosure.
Figure 3:
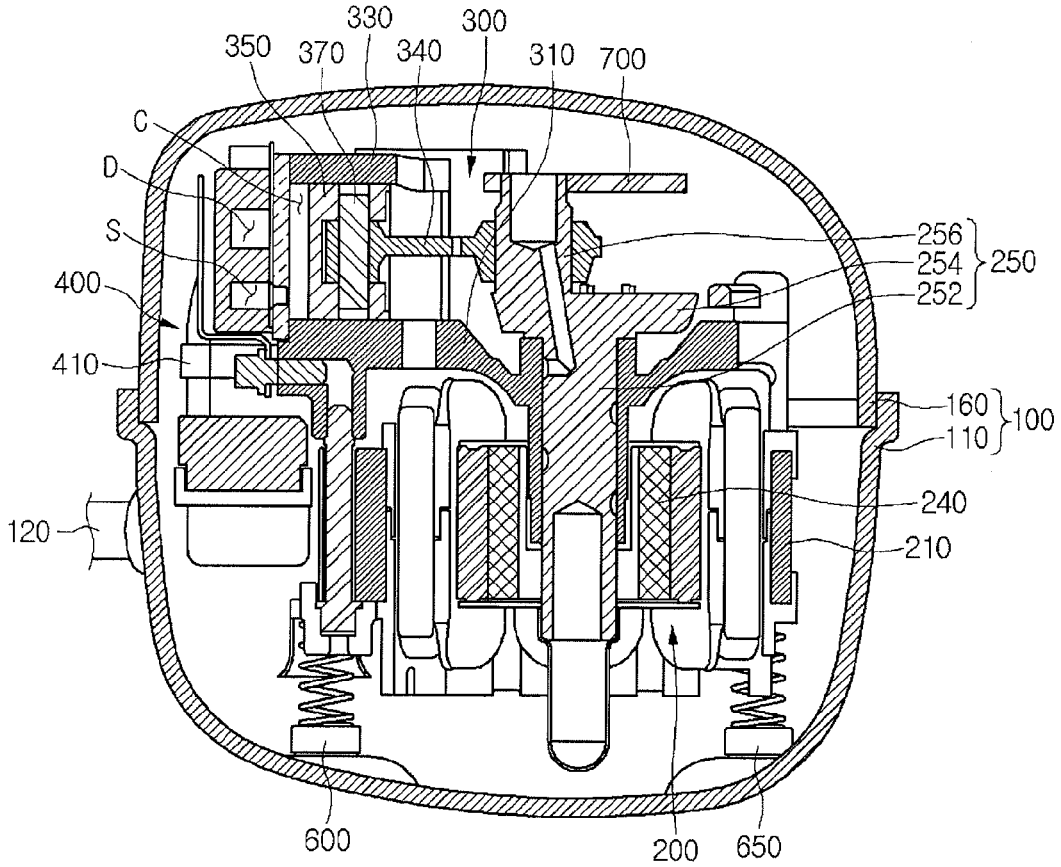
FIG. 3 is a cross-sectional view of a reciprocating compressor according to an embodiment of the present disclosure.

FIG. 1 is a perspective view of a reciprocating compressor according to an embodiment of the present disclosure, FIG. 2 is an exploded perspective view of a reciprocating compressor according to an embodiment of the present disclosure, and FIG. 3 is a cross-sectional view of a reciprocating compressor according to an embodiment of the present disclosure.

Referring to FIGS. 1 to 3, a reciprocating compressor 10 according an embodiment of the present disclosure may include a shell 100 forming an exterior, a driving unit or driver 200 disposed at an inner space of the shell 100 to provide a driving force, a compression unit or compressor 300 configured to receive the driving force from the driving unit 200 to compress a refrigerant by a linear reciprocating motion, and a suction/discharge unit or suction/discharge assembly 400 configured to suction a refrigerant for compressing a refrigerant in the compression unit 300 and discharge the refrigerant compressed in the compression unit 300.

The shell 100 may form a closed space at an inner portion thereof and accommodate various types of parts that form the reciprocating compressor 10 in the closed space. The shell 100 may be formed of a metallic material and include a lower shell 110 and an upper shell 160.

The lower shell 110 may be formed in a nearly hemispherical shape, and, together with the upper shell 160, forms an accommodation space which accommodates various parts forming the driving unit 200, the compression unit 300 and the discharge unit 400. The lower shell 110 may be called a "main compressor body" and the upper shell 160 may be called a "compressor cover."

A suction pipe 120, a discharge pipe 130, a process pipe 140, and a power unit are disposed at the lower shell 110. The suction pipe 120 may introduce a refrigerant into an inner portion of the shell 100 and be mounted by penetrating the lower shell 110. The suction pipe 120 may be mounted separately from the lower shell 110 or be integrated with the lower shell 110.

The discharge pipe 130 may discharge a refrigerant compressed in the shell 100 and be mounted by penetrating the lower shell 110. The discharge pipe 130 may also be mounted separately from the lower shell 110 or integrated with the lower shell 110.

A discharge hose 458 of the suction/discharge unit 400, to be described in greater detail below, may be connected to the discharge pipe 130. A refrigerant introduced into the suction pipe 120 and compressed by the compression unit 300 may pass through the discharge hose 458 of the suction/discharge unit 400 and be discharged to the discharge pipe 130.

The process pipe 140 may be provided to charge a refrigerant in an inner portion of the shell 100 after sealing the inner portion of the shell 100, and, similar to the suction pipe 120 and the discharge pipe 130, may be mounted by penetrating the lower shell 110.

The upper shell 160 may form the accommodation space together with the lower shell 110, and be formed in a nearly hemispherical shape similar to that of the lower shell 110. The upper shell 160 may be coupled to the lower shell 110 at an upper portion of the lower shell 110 to form a closed space therein.

The driving unit 200 may include stator elements 210 and 220, an insulator 230, a rotor 240, and a rotary shaft 250. The stator elements 210 and 220 are portions that are fixed during an operation of the driving unit 200 and may include a stator core 210 and a stator coil 220.

The stator core 210 may be formed of a metallic material, and may form a nearly cylindrical shape having a hollow formed therein. In addition, the stator coil 220 may be mounted inside the stator core 210. When power is applied from the outside, the stator coil 220 generates an electromagnetic force to perform an electromagnetic reciprocal action with the stator core 210 and the rotor 240. As a result, the driving unit 200 may generate a driving force to be converted to a reciprocating motion of the compression unit 300.

The insulator 230 may be disposed between the stator core 210 and the stator coil 220 to prevent direct contact between the stator core 210 and the stator coil 220 because generation of the electromagnetic force from the stator coil 220 may be interrupted if the stator coil 220 comes in direct contact with the stator core 210. The insulator 230 may enable the stator core 210 and the stator coil 220 to be a predetermined distance from each other.

The rotor 240 is a portion which rotates during the operation of the driving unit 200. The rotor 240 may be rotatably disposed inside the stator coil 220 and installed inside the insulator 230. A magnet may be disposed at the rotor 240. When power is supplied from the outside, the rotor 240 may rotate by the electromagnetic reciprocal action with the stator core 210 and the stator coil 220. A rotary force in accordance with the rotation of the rotor 240 may act as a driving force capable of driving the compression unit 300.

The rotary shaft 250 may be installed inside the rotor 240 and mounted to penetrate the rotor 240 in a vertical direction (z-axis direction in the figures), and may rotate together with the rotor 240. In addition, the rotary shaft 250 may be connected to a connecting rod 340, discussed in greater detail below, to transmit the rotary force generated in the rotor 240 to the compression unit 300.

Specifically, the rotary shaft 250 may include a base shaft 252, a rotary plate 254, and an eccentric shaft 256. The base shaft 252 may be mounted inside the rotor 240 in the vertical direction or a longitudinal direction. When the rotor 240 rotates, the base shaft 252 may rotate together with the rotor 240.

The rotary plate 254 may be installed at one side of the base shaft 252, and be rotatably mounted on a rotary plate seating unit 320 of a cylinder block 310, which will be described below.

The eccentric shaft 256 may protrude upward from an upper surface of the rotary plate 254. Specifically, the eccentric shaft 256 may protrude from a position eccentric from an axial center of the base shaft 252 to eccentrically rotate when the rotary plate 254 rotates. The connecting rod 340 may be mounted on the eccentric shaft 256. In accordance with the eccentric rotation of the eccentric shaft 256, the connecting rod 340 may linearly reciprocate in a horizontal direction.

The compression unit 300 may include the cylinder block 310, the connecting rod 340, a piston 350, and a piston pin 370. The cylinder block 310 may be disposed at the driving unit 200, more specifically, above the rotor 240, and mounted inside the shell 100. The cylinder block 310 may include the rotary plate seating unit 320 and a cylinder 330.

The rotary plate seating unit 320 may be formed at a lower portion of the cylinder block 310 to rotatably accommodate the rotary plate 254. A shaft opening 322 through which the rotary shaft 250 can penetrate may be formed at the rotary plate seating unit 320.

The cylinder 330 may be provided at a front portion of the cylinder block 310, and disposed to accommodate the piston 350. The piston 350 may reciprocate in the horizontal direction and a compression space (C) capable of compressing a refrigerant may be formed at an inner portion of the cylinder 330.

The cylinder 330 may be formed of an aluminum material. As an example, the cylinder 330 may be formed of aluminum or an aluminum alloy. Due to the aluminum material, which is a substantially nonmagnetic material, a magnetic flux generated in the rotor 240 may not be transmitted to the cylinder 330. Accordingly, the magnetic flux generated in the rotor 240 may be prevented from being transmitted to the cylinder 330 and leaking from the cylinder 330.

The connecting rod 340 transmits the driving force provided from the driving unit 200 to the piston 350, and, as described above, may convert a rotary motion of the rotary shaft 250 to a linear reciprocating motion. Specifically, the connecting rod 340 may linearly reciprocate in the horizontal direction when the rotary shaft 250 rotates. The connecting rod 340 may be formed of a sintered alloy material.

The piston 350 compresses a refrigerant, and may be accommodated in the cylinder 330 so as to be capable of reciprocating in the horizontal direction. The piston 350 may be connected to the connecting rod 340 and the piston 350 may linearly reciprocate in the cylinder 330 in accordance with a motion of the connecting rod 340. In accordance with the reciprocating motion of the piston 350, a refrigerant introduced from the suction pipe 120 may be compressed in the cylinder 330.

Similar to the cylinder 330, the piston 350 may be formed of an aluminum material, such as aluminum or an aluminum alloy. Consequently, a magnetic flux generated in the rotor 240 may be prevented from leaking to the outside through the piston 350.

The piston 350 may be formed of the same material as the cylinder 330 and have a thermal expansion coefficient almost equal to that of the cylinder 330. As the piston 350 has a thermal expansion coefficient almost equal to that of the cylinder 330, the piston 350 may be thermally deformed almost as much as the cylinder 330 in an internal environment of the shell 100 at a high temperature (generally, approximately 100° C.) when the reciprocating compressor 10 operates. Consequently, interference between the piston 350 and the cylinder 330 may be prevented when the piston 350 reciprocates in the cylinder 330.

The piston pin 370 may couple the piston 350 to the connecting rod 340. Specifically, the piston pin 370 may penetrate the piston 350 and the connecting rod 340 in the vertical direction and connect the piston 350 to the connecting rod 340.

The suction/discharge unit 400 may include a muffler assembly 410, a valve assembly 480, the discharge hose 458, a plurality of gaskets 485 and 488, an elastic member 490 and a clamp 492.

The muffler assembly 410 may transfer a refrigerant suctioned from the suction pipe 120 to an inner portion of the cylinder 330 and transfer a refrigerant compressed in the compression space (C) of the cylinder 330 to the discharge pipe 130. To assist in this process, a suction space (S) configured to accommodate the refrigerant suctioned from the suction pipe 120 and a discharge space (D) configured to accommodate the refrigerant compressed in the compression space (C) of the cylinder 330 may be provided at the muffler assembly 410.

Specifically, the refrigerant suctioned from the suction pipe 120 may be introduced into a suction space (S) of a suction/discharge tank 426 through first and second assemblies 430 and 420, which may be referred to as suction mufflers, which are described in greater detail below. In addition, the refrigerant compressed in the cylinder 330 may pass through a discharge space (D) of the suction/discharge tank 426, through third and fourth assemblies 425 and 438, which may be referred to as discharge mufflers, and be discharged to the outside of the reciprocating compressor 10 through the discharge hose 458.

The valve assembly 480 may guide the refrigerant in the suction space (S) to the inner portion of the cylinder 330 or guide the refrigerant compressed in the cylinder 330 to the discharge space (D). A discharge valve 483 openably/closably mounted to discharge the refrigerant compressed in the compression space (C) to the discharge space (D) may be provided at a front surface of the valve assembly 480, and a suction valve 481 openably/closably mounted to discharge the refrigerant in the suction space (S) to the compression space (C) of the cylinder 330 may be provided at a rear surface of the valve assembly 480. In other words, the discharge valve 483 may be disposed at the front surface of the valve assembly 480, and the suction valve 481 may be disposed at the rear surface of the valve assembly 480. Actions of the discharge valve 483 and the suction valve 481 will be briefly described.

When the refrigerant compressed in the compression space (C) of the cylinder 330 is discharged, the discharge valve 483 may be opened and the suction valve 481 may be closed. Accordingly, the refrigerant compressed in the cylinder 330 may be introduced into the discharge space (D) without being introduced into the suction space (S). Conversely, when the refrigerant introduced into the suction space (S) is suctioned into the cylinder 330, the discharge valve 483 may be closed and the suction valve 481 may be opened. Accordingly, the refrigerant in the suction space (S) may be introduced into the cylinder 330 without being introduced into the discharge space (D).

The discharge hose 458 transfers a compressed refrigerant accommodated in the discharge space (D) to the discharge pipe 130, and may be coupled to the muffler assembly 410. For example, one side of the discharge hose 458 may be coupled to the muffler assembly 410 to be in communication with the discharge space (D) and the other side of the discharge hose 458 may be coupled to the discharge pipe 130.

The plurality of gaskets 485 and 488 may be provided to prevent leakage of a refrigerant, and may be respectively mounted on one side and the other side of the valve assembly 480. Specifically, the plurality of gaskets 485 and 488 may include a first gasket 485 and a second gasket 488. The first gasket 485 may be mounted in front of the valve assembly 480, and the second gasket 488 may be mounted behind the valve assembly 480. The first gasket 485 and the second gasket 488 may be formed nearly in the shape of a ring, but the shape is not limited thereto and may be properly changed in accordance with a design as long as the shape is a structure capable of preventing leakage of a refrigerant.

The elastic member 490 supports the muffler assembly 410 during an operation of the reciprocating compressor 10, and may be mounted in front of the muffler assembly 410. The elastic member 490 may include a Belleville spring.

The clamp 492 may fix the valve assembly 480, the first gasket 485, the second gasket 488, and the elastic member 490 to the muffler assembly 410. The clamp 492 may be formed nearly in the shape of a trivet, and mounted on the muffler assembly 410 by a fastener such as a screw.

Furthermore, the reciprocating compressor 10 may further include a plurality of damper members 500, 550, 600 and 650, and a balance weight 700. The plurality of damper members 500, 550, 600, and 650 may buffer vibration of inner structures of the reciprocating compressor 10 generated during the operation of the reciprocating compressor 10. The plurality of damper members 500, 550, 600, and 650 may include a front damper 500, a rear damper 550, and lower dampers 600 and 650.

The front damper 500 may buffer vibration of the suction/discharge unit 400 and be formed of a rubber material. The front damper 500 may be coupled to a front upper portion of the cylinder block 310 by a fastener coupled to the clamp 492.

The rear damper 550 may buffer vibration of the compression unit 300, and be mounted on a rear upper portion of the cylinder block 310. The rear damper 550 may be formed of a rubber material.

The lower dampers 600 and 650 may buffer vibration of the driving unit 200 and be provided in a plurality. The plurality of lower dampers 600 and 650 may include a front lower damper 600 and a rear lower damper 650. The front lower damper 600 may buffer front vibration of the driving unit 200 and be mounted on a front lower portion of the stator core 210. The rear lower damper 650 may buffer a rear vibration of the driving unit 200 and be mounted on a rear lower portion of the stator core 210.

The balance weight 700 may be provided to control rotary vibration when the rotary shaft 250 of the driving unit 200 rotates, and may be coupled to the eccentric shaft 256 of the rotary shaft 250 above the connecting rod 340.

Figure 4:
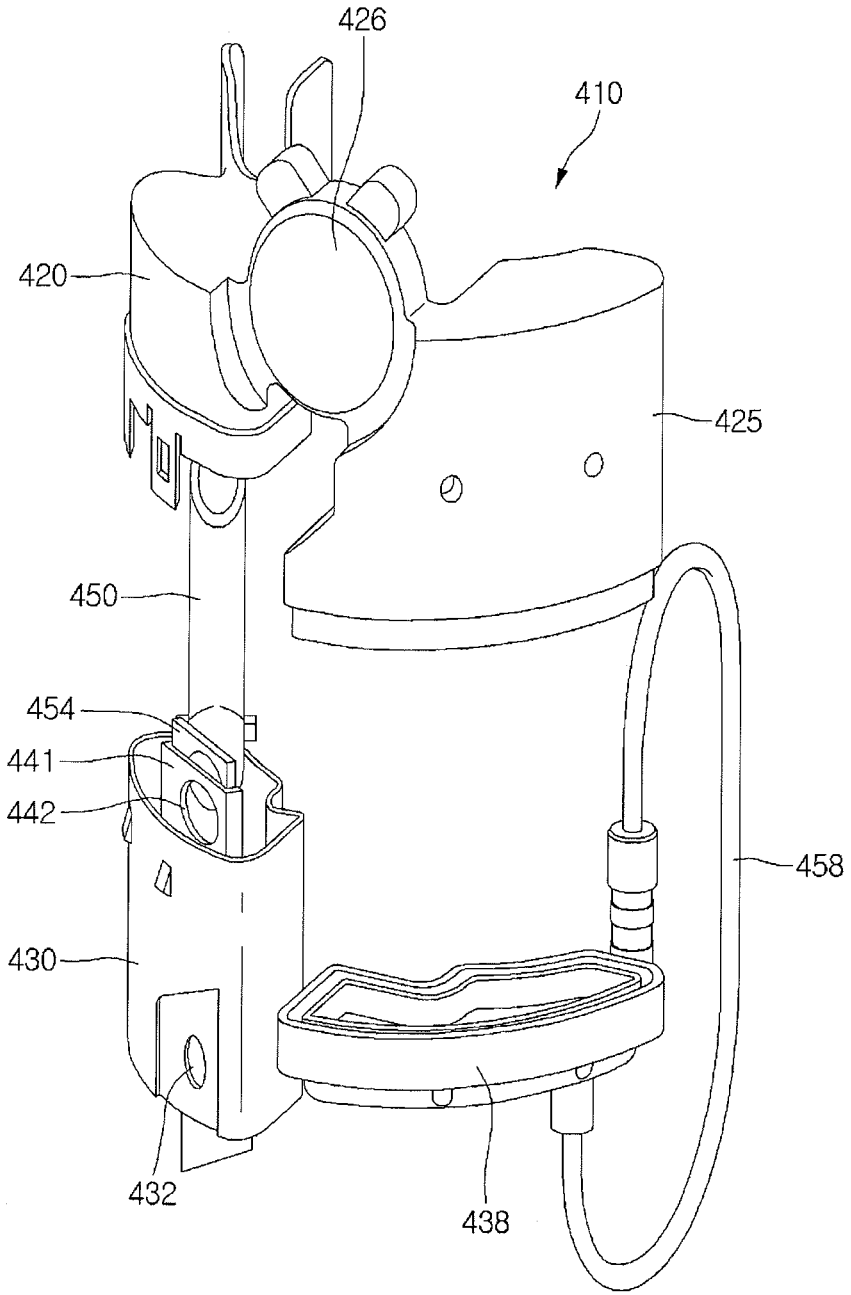
FIG. 4 is a view illustrating a front configuration of a muffler assembly according to an embodiment of the present disclosure.

Hereinafter, the muffler assembly 410 will be described in detail. FIG. 4 is a view illustrating a front configuration of a muffler assembly according to an embodiment of the present disclosure, and FIG. 5 is a view illustrating a rear configuration of the muffler assembly according to an embodiment of the present disclosure.

Figure 5:
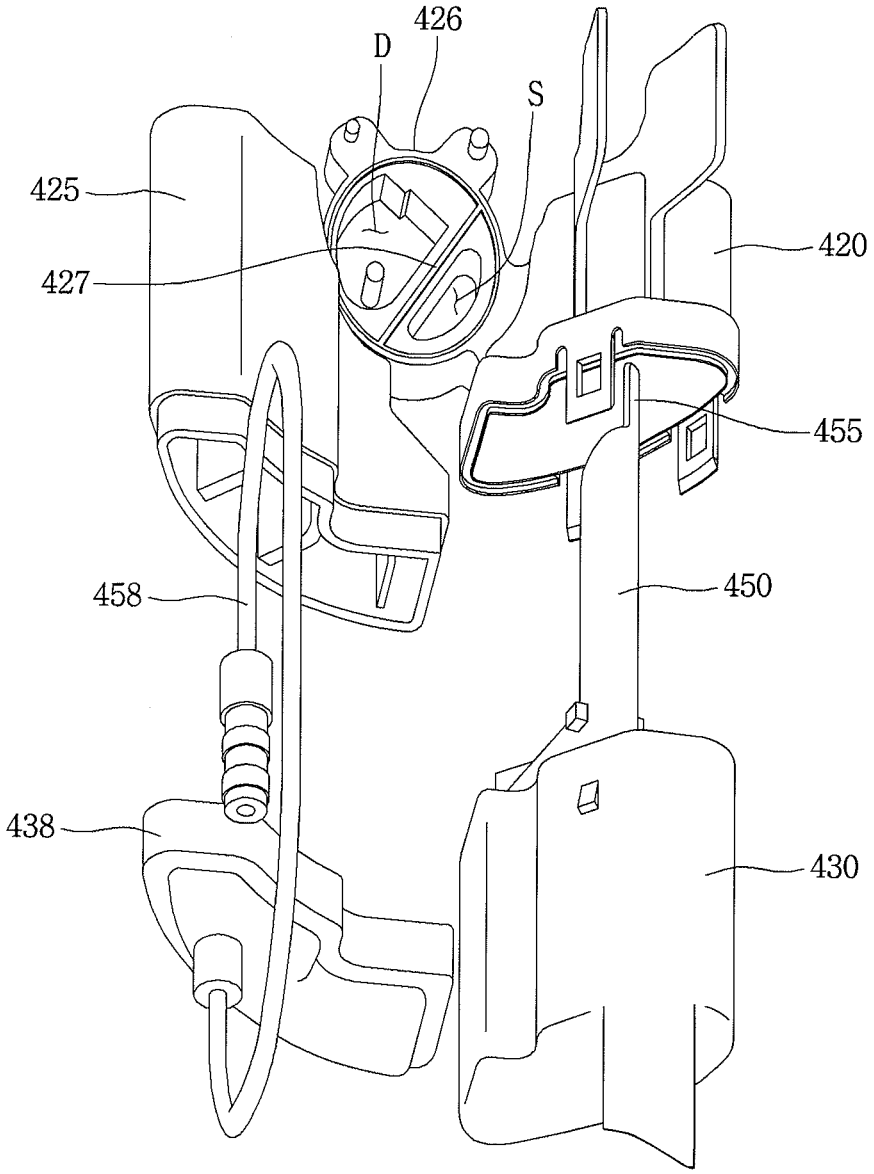
FIG. 5 is a view illustrating a rear configuration of the muffler assembly according to an embodiment of the present disclosure.

Referring to FIGS. 4 and 5, the muffler assembly 410 according to an embodiment of the present disclosure may include the first assembly 430, the second assembly 420, the third assembly 425, and the fourth assembly 438. The first assembly 430 may include a suction hole 432 capable of being placed in communication with the suction pipe 120. The suction hole 432 may be positioned to abut an inner portion of one point of the lower shell 110 to which the suction pipe 120 is coupled.

An inner pipe 450 may be installed at an inner portion of the first assembly 430. As an example, the inner pipe 450 may be configured with a pipe formed in a nearly cylindrical shape.

A first fixing unit or first member 441 for fixing the inner pipe 450 may be installed at the inner portion of the first assembly 430. A through hole 442 corresponding to the suction hole 432 may be formed at the first fixing unit 441. Consequently, the suction hole 432 and the through hole 442 may be aligned with each other while the first fixing unit 441 is installed at an inner portion of the first assembly 430. In addition, the inner pipe 450 may include a first coupling unit or first coupler 454 coupled to the first fixing unit 441.

The inner pipe 450 may extend upward from the first assembly 430 to be coupled to the second assembly 420. The second assembly 420 may include a second fixing unit or second member (424, refer to FIG. 8) coupled to the inner pipe 450. In addition, the inner pipe 450 may include a second coupling unit or second coupler 455 coupled to the second fixing unit 424.

The second assembly 420 may be coupled to an upper portion of the first assembly 430. At least a portion of the inner pipe 450 may be positioned at an inner portion of the first assembly 430, and the other portion of the inner pipe 450 may be positioned at an inner portion of the second assembly 420.

When the first assembly 430 is coupled to the second assembly 420, a suction flow passage through which a refrigerant suctioned into the reciprocating compressor 10 may flow toward the cylinder 330 may be formed at inner portions of the first and second assemblies 430 and 420. Consequently, the first and second assemblies 430 and 420 together may be called a "suction muffler."

The third assembly 425 may be disposed apart from one side of the second assembly 420. In addition, between the second assembly 420 and the third assembly 425, the suction/discharge tank 426 forming the suction space (S) and the discharge space (D) may be installed. The suction/discharge tank 426 may include a dividing unit or divider 427 configured to divide an inner space of the suction/discharge tank 426 into the suction space (S) and the discharge space (D). In addition, the valve assembly 480 may be installed at one side of the suction/discharge tank 426, the suction space (S) may be blocked by the suction valve 481, and the discharge space (D) may be blocked by the discharge valve 483.

The fourth assembly 438 may be coupled to a lower portion of the third assembly 425. When the third assembly 425 is coupled the fourth assembly 438, a discharge flow passage through which a refrigerant discharged from the cylinder 330 flows toward the discharge pipe 130 may be formed at inner portions of the third and fourth assemblies 425 and 438. Consequently, the third and fourth assemblies 425 and 438 together may be called a "discharge muffler."

The discharge hose 458 may be coupled to the fourth assembly 438. The discharge hose 458 may transfer a refrigerant inside the fourth assembly 438 to the discharge pipe 130. One side of the discharge hose 458 may be coupled to the fourth assembly 438 and the other side thereof may be coupled to the discharge pipe 130.

Figure 6:
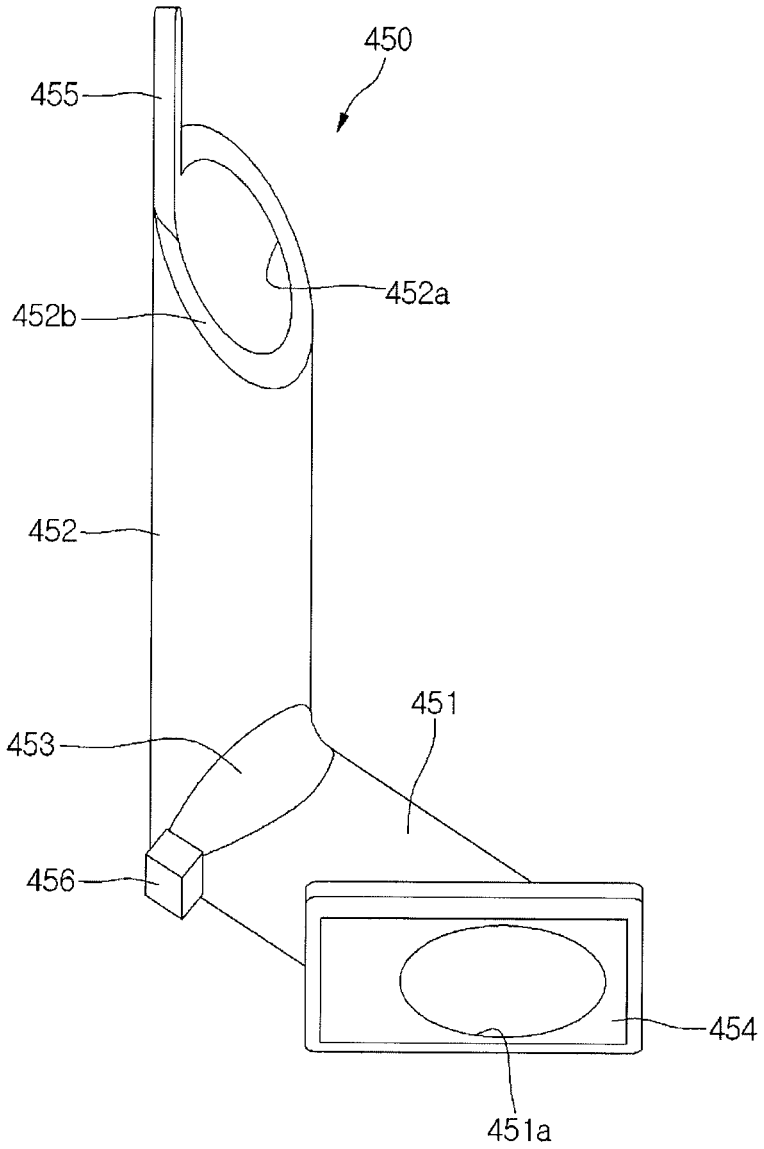
FIG. 6 is a view illustrating a configuration of an inner pipe according to an embodiment of the present disclosure.
Figure 7:
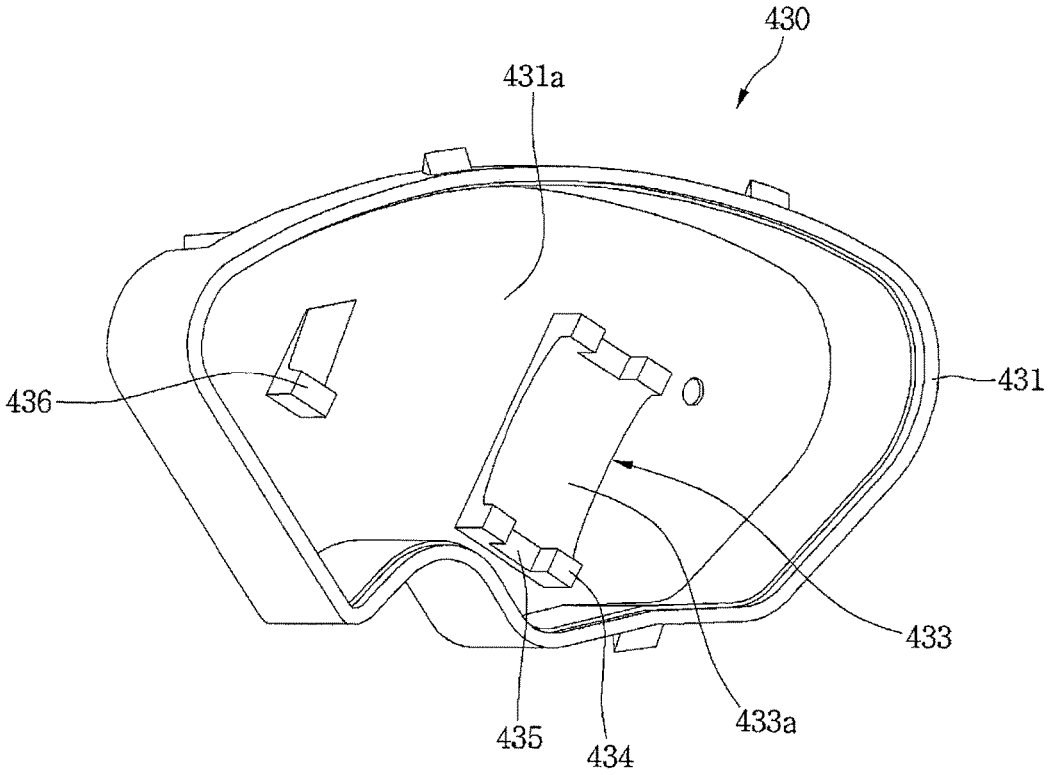
FIG. 7 is a view illustrating a configuration of a first assembly according to an embodiment of the present disclosure.
Figure 8:
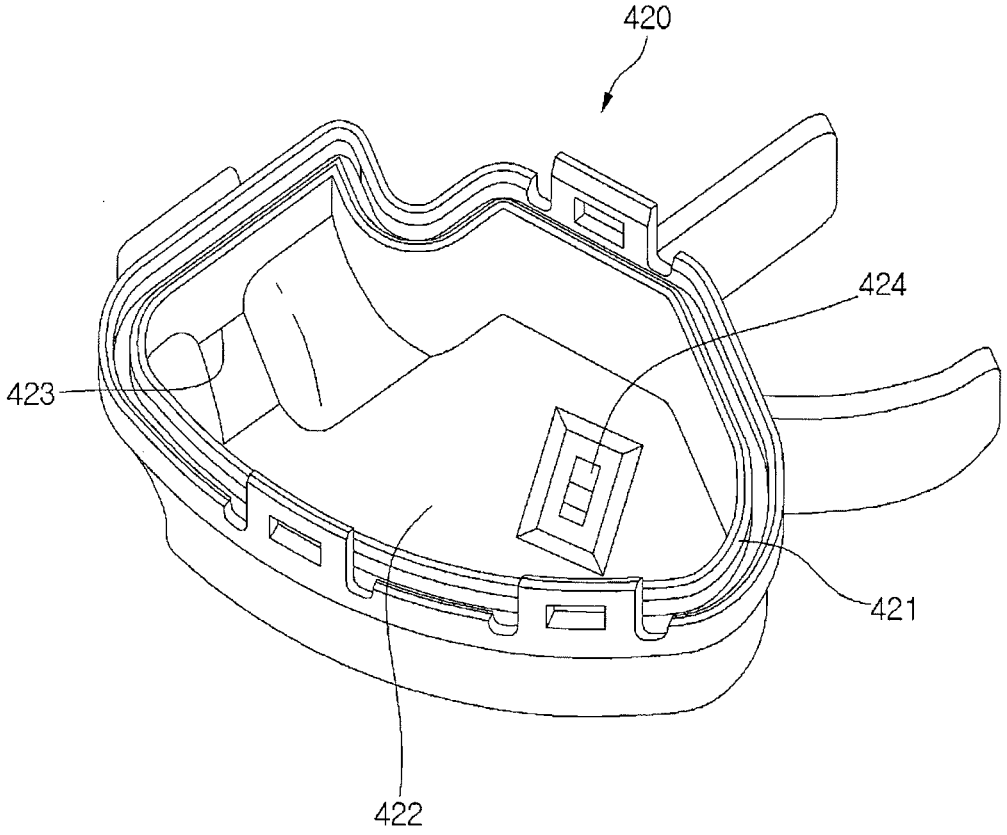
FIG. 8 is a view illustrating a configuration of a second assembly according to an embodiment of the present disclosure.
Figure 9:
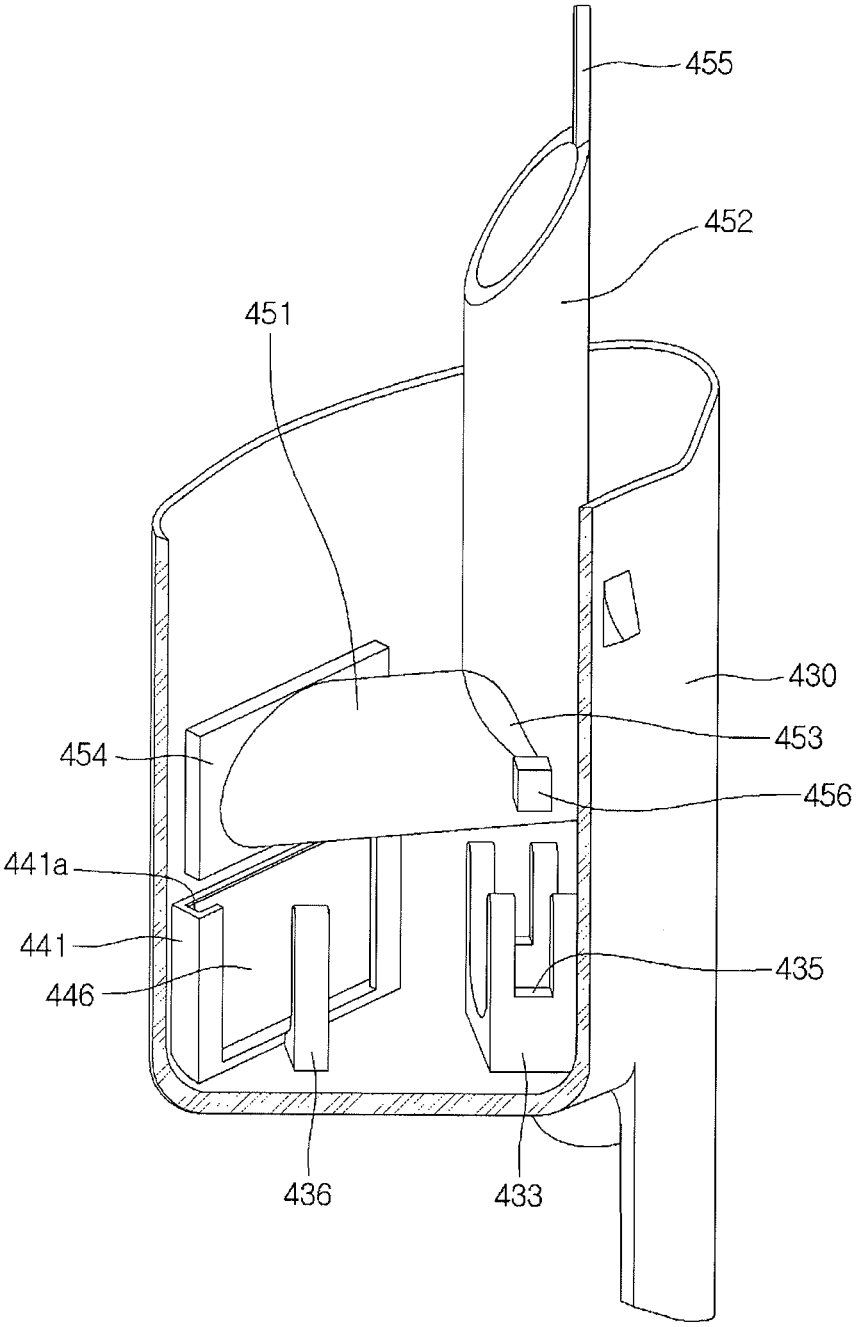
FIG. 9 is a partial, section view illustrating a state in which the inner pipe is coupled to the first assembly according to an embodiment of the present disclosure.

FIG. 6 is a view illustrating a configuration of an inner pipe according to an embodiment of the present disclosure, FIG. 7 is a view illustrating a configuration of a first assembly according to an embodiment of the present disclosure, FIG. 8 is a view illustrating a configuration of a second assembly according to an embodiment of the present disclosure, and FIG. 9 is a partial, section view illustrating a state in which the inner pipe is coupled to the first assembly according to an embodiment of the present disclosure.

Referring to FIGS. 6 to 9, the inner pipe 450 according to an embodiment of the present disclosure may include a first pipe main body or first pipe portion 451 coupled to an inner surface of the first assembly 430 and configured to extend in a first direction, a second pipe main body or second pipe portion 452 configured to extend from the first pipe main body 451 in a second direction, and a connecting portion 453 configured to connect the first pipe main body 451 to the second pipe main body 452. As an example, the first direction may be a horizontal direction corresponding to a horizontal surface and the second direction may be upward or vertical with respect to the horizontal surface.

The first pipe main body 451 and the second pipe main body 452 may be integrally formed. In this arrangement, the connecting portion 453 may be understood as forming a "bent portion" bent from the first pipe main body 451 toward the second pipe main body 452.

The first pipe main body 451 may include a pipe suction hole 451*a* having a shape corresponding to the suction hole 432 of the first assembly 430. The pipe suction hole 451*a* may be formed at an end portion of the first pipe main body 451. When the first pipe main body 451 is coupled to an inner surface of the first assembly 430, the suction hole 432 and the pipe suction hole 451*a* may be aligned with each other.

The first pipe main body 451 may further include a first coupling unit or first coupler 454 coupled to the first assembly 430. The first coupling unit 454 may be installed at an end portion of the first pipe main body 451, and disposed to surround the pipe suction hole 451*a* by protruding outward from an outer circumferential surface of the pipe suction hole 451*a*.

The first assembly 430 may include a first fixing unit 441 coupled to the first coupling unit 454. The first fixing unit 441 may be coupled to an inner surface of the first assembly 430, and, specifically, to the inner surface in which the suction hole 432 is formed.

A fitting groove 441*a* may be formed at the first fixing unit 441. The first coupling unit 454 may be inserted into the fitting groove 441*a*. Specifically, the first coupling unit 454 may be inserted into the fitting groove 441*a* by moving from a position above the fitting groove 441*a* down into an inner portion of the fitting groove 441*a*.

The second pipe main body 452 may include a discharge end portion 452*b* configured to define a pipe discharge hole 452*a* through which a refrigerant that has flowed through the inner pipe 450 is discharged. The pipe discharge hole 452*a* may be aligned with a discharge hole 423 at the second assembly 420. In addition, the discharge end portion 452*b* may be understood as one end portion of the second pipe main body 452, and may be formed at a slant with respect to a horizontal surface.

As the discharge end portion 452*b* extends at a slant, the discharge end portion 452*b* may face the discharge hole 423 at the second assembly 420 when the inner pipe 450 is installed at inner portions of the first and second assemblies 430 and 420. Consequently, a refrigerant discharged through the pipe discharge hole 452*a* may easily flow to the discharge hole 423.

The second pipe main body 452 may further include a second coupling unit or second coupler 455 configured to protrude from the discharge end portion 452*b* to be coupled to the second fixing unit 424 of the second assembly 420. The second coupling unit 455 may protrude upward from the discharge end portion 452*b*.

The inner pipe 450 further includes a third coupling unit or third coupler 456 disposed at the connecting portion 453. The third coupling unit 456 is coupled to a third fixing unit 433 disposed at the first assembly 430, and may be configured by protruding from both side surfaces of the connecting portion 453. Since the connecting portion 453 may be understood as a bent portion of the inner pipe 450 as mentioned above, the third coupling unit 456 may be understood as being installed at the bent portion.

Since a plurality of coupling units coupled to the first assembly 430 or the second assembly 420 are disposed at the inner pipe 450, as mentioned above, a vibration generated in the inner pipe 450 due to a refrigerant being suctioned or a noise caused by the vibration may be prevented when the inner pipe 450 is installed at inner portions of the first and second assemblies 430 and 420.

The first assembly 430 may define a lower assembly of the suction muffler. Specifically, the first assembly 430 may include a first main assembly body 431 having an inner space in which at least a portion of the inner pipe 450 is installed. In addition, the first main assembly body 431 may include a bottom surface portion 431*a*.

The third fixing unit 433 coupled to the third coupling unit 456 of the inner pipe 450 may be installed at the bottom surface portion 431*a*. The third fixing unit 433 may protrude upward from the bottom surface portion 431*a*. Specifically, the third fixing unit 433 may include a main fixing body 433*a* configured to support at least a portion of the inner pipe 450, particularly a lower portion of the first pipe main body 451. The main fixing body 433*a* may be formed in a round shape to correspond to the shape of the first pipe main body 451.

The third fixing unit 433 may include a plurality of protrusions 434 disposed at both sides of the main fixing body 433*a*, and seating grooves 435 formed to be recessed between the plurality of protrusions 434 to allow the third coupling unit 456 to be seated therein.

The bottom surface portion 431*a* may further include a support unit or supporter 436 configured to support another portion of the inner pipe 450. The support unit 436 may be configured to support a portion of the first pipe main body 451 apart from the third fixing unit 433. In addition, the first fixing unit 441 may be installed between the support unit 436 and an inner surface of the first assembly 430. Consequently, the support unit 436 may also perform a function of supporting the first fixing unit 441.

The second assembly 420 may define an upper assembly of the suction muffler. Specifically, the second assembly 420 may include a second main assembly body 421 having an inner space in which at least a portion of the inner pipe 450 is installed. In addition, the second main assembly body 421 may include an upper surface portion 422 forming an exterior of an upper surface of the suction muffler.

The discharge hole 423, which is configured to guide a refrigerant discharged from the inner pipe 450 to the suction space (S) of the suction/discharge tank 426, may be formed at one surface of the second main assembly body 421. The discharge hole 423 may be formed when at least a portion of the second main assembly body 421 is penetrated, and may come into communication with the suction space (S) of the suction/discharge tank 426.

The upper surface portion 422 may include the second fixing unit 424 to which the second coupling unit 455 of the inner pipe 450 is coupled. The second fixing unit 424 may include a groove into which the second coupling unit 455 may be inserted.

A filter 446 capable of filtering a foreign substance in a refrigerant suctioned through the suction hole 432 may be installed at an inner portion of the suction hole 432 of the first assembly 430. The filter 446 may be coupled to the first fixing unit 441. Specifically, the first fixing unit 441 may include the fitting groove 441*a* into which the filter 446 and the first coupling unit 454 may be inserted. The filter 446 may be positioned between the suction hole 432 and the first fixing unit 454. Consequently, the filter 446 may be attached close to the suction hole 432 by the first coupling unit 454 and the coupling state of the filter 446 may be firmly maintained without a separate fixing member.

A method for coupling the suction muffler 430 and 420 to the inner pipe 450 will be described.

The first fixing unit 441 may be installed at an inner surface of the first assembly 430. In this arrangement, the first fixing unit 441 may be installed at a position corresponding to the suction hole 432 of the first assembly 430. In addition, the filter 446 may be fitted into the fitting groove 441*a* of the first fixing unit 441.

The inner pipe 450 may be moved downward from a portion above the first assembly 430 toward the inner portion of the first assembly 430, and the first fixing unit 454 may be fitted into the fitting groove 441*a* of the first fixing unit 441. In this manner, when the coupling of the first coupling unit 454 is complete, the filter 446 may be closely held between the suction hole 432 and the first coupling unit 454. In addition, the third coupling unit 456 may be seated at the seating grooves 435 of the third fixing unit 433 during when the inner pipe 450 is moved downward. When the third coupling unit 456 is seated at the seating grooves 435, the third coupling unit 456 may be stably supported by the plurality of protrusions 434.

After the inner pipe 450 is coupled to the first assembly 430, the second coupling unit 455 of the inner pipe 450 may be coupled to the second fixing unit 424 of the second assembly 420 during a process in which the second assembly 420 is coupled to the first assembly 430. Since the inner pipe 450 may be coupled to the first and second assemblies 430 and 420 at a plurality of points, as set forth above, the inner pipe 450 may be stably supported inside the first and second assemblies 430 and 420. In addition, the first and second assemblies 430 and 420 may be easily and conveniently assembled during a process in which the inner pipe 450 is moved downward.

According to the present disclosure, an inner pipe may be firmly coupled to an inner portion of a suction muffler, thereby decreasing generation of vibration in the inner pipe while a refrigerant is being suctioned, and thus maintaining stiffness of the inner pipe.

Particularly, a plurality of coupling units may be provided at a plurality of points at the inner pipe having a bent shape, and the plurality of coupling units may be firmly fixed inside the suction muffler.

In addition, the inner pipe may be easily and conveniently assembled with first and second assemblies during a process in which the inner pipe moves downward.

Hereinbefore, preferred embodiments of the present disclosure have been shown and described, but the present disclosure is not limited to the particular embodiments mentioned above. The embodiments may be modified in various ways by those of ordinary skill in the art to which the present disclosure pertains without departing from the gist of the present disclosure which is claimed in the claims below, and such modifications should not be understood as separate from the technical spirit or purview of the present disclosure.

What is claimed is:

1. A reciprocating compressor comprising:

a shell having an inner portion;

a suction pipe coupled to the shell;

a driver located at the inner portion of the shell to generate a rotary force;

a compressor located in the shell, the compressor including:

a connecting rod configured to convert the rotary force to a linear driving force;

a piston connected to the connecting rod; and a cylinder into which the piston is movably inserted; and a muffler assembly configured to transfer a refrigerant suctioned through the suction pipe to the cylinder, the muffler assembly including:

a suction muffler including a first assembly having a suction hole through which a refrigerant is suctioned, a second assembly coupled to an upper side of the first assembly and having a discharge hole, and a first inner portion formed inside the first and the second assemblies;

a discharge muffler including a third assembly, a fourth assembly coupled to a lower side of the third assembly, and a second inner portion formed inside of the third and fourth assemblies; and a tank installed between the second assembly and the third assembly and having a suction space into which refrigerant passing through the suction muffler is introduced and a discharge space into which refrigerant compressed in the cylinder is introduced, wherein the suction muffler includes:

an inner pipe installed at the first inner portion of the first and the second assemblies and configured to provide communication between the suction hole and the cylinder, the inner pipe including a first pipe portion that is coupled to the first assembly and extends horizontally, a second pipe portion that is coupled to the second assembly and extends vertically and a bent portion to connect the first pipe portion with the second pipe portion, the second pipe portion having a first coupler to be coupled with the second assembly; and a second coupler disposed at the bent portion, the second coupler located at the first inner portion of the first and the second assemblies and coupled with the first assembly, wherein the second pipe portion includes a top surface to be slanted with respect to the first pipe portion, the top surface facing the tank, and wherein the first coupler includes a protrusion that protrudes upward from the top surface.

2. The reciprocating compressor according to claim 1, wherein the inner pipe further comprises:

a third coupler disposed at the first pipe portion and coupled to an inner portion of the suction hole.

3. The reciprocating compressor according to claim 2, wherein the first assembly comprises a first member coupled to the third coupler, the first member having a fitting groove, and wherein the third coupler is inserted into the fitting groove.

4. The reciprocating compressor according to claim 3, further comprising a filter installed at the fitting groove to filter a foreign substance in a refrigerant introduced through the suction hole.

5. The reciprocating compressor according to claim 1, wherein the suction muffler further comprises a second member disposed at an upper, inner surface of the second assembly, the second member having a groove, and wherein the first coupler is coupled to the groove.

6. The reciprocating compressor according to claim 1, wherein the suction muffler further comprises a third member disposed at a bottom surface of the first assembly, and wherein the second coupler is coupled to the third member.

7. The reciprocating compressor according to claim 6, wherein the third member comprises:

a plurality of protrusions; and seating grooves formed between adjacent protrusions of the plurality of protrusions on opposite sides of the third member, and wherein the second coupler is inserted into the seating grooves.

8. The reciprocating compressor according to claim 6, wherein the suction muffler further comprises a supporter disposed at the bottom surface of the first assembly, the supporter being spaced apart from the third member to support a lower portion of the inner pipe.

9. The reciprocating compressor according to claim 1, wherein the inner pipe further comprises:

a pipe suction hole formed at the first pipe portion and aligned with the suction hole; and a pipe discharge hole formed at the second pipe portion and aligned with the discharge hole.

10. The reciprocating compressor according to claim 1, wherein the second coupler protrudes from opposite side surfaces of the bent portion to be coupled to the suction muffler.

11. The reciprocating compressor according to claim 1, further comprising a discharge pipe coupled to the shell, wherein the muffler assembly includes a discharge hose connecting the discharge muffler to the discharge pipe.

* * * * *